US007893372B2

(12) United States Patent
Malfois et al.

(10) Patent No.: US 7,893,372 B2
(45) Date of Patent: Feb. 22, 2011

(54) REMOTE CONTROL FOR A MOBILE MACHINE, IN PARTICULAR A HEAVY CONSTRUCTION MACHINE, AGRICULTURAL OR HANDLING MACHINE

(75) Inventors: Frédéric Malfois, Saint-Genis-Laval (FR); Mathieu Marron, Lyons (FR)

(73) Assignee: Bosch Rexroth D.S.I., Venissieux (FR)

( * ) Notice: Subject to any disclaimer, the term of this patent is extended or adjusted under 35 U.S.C. 154(b) by 322 days.

(21) Appl. No.: 12/086,329

(22) PCT Filed: Dec. 28, 2006

(86) PCT No.: PCT/FR2006/002899

§ 371 (c)(1),
(2), (4) Date: Jun. 24, 2008

(87) PCT Pub. No.: WO2007/080293

PCT Pub. Date: Jul. 19, 2007

(65) Prior Publication Data

US 2008/0302648 A1 Dec. 11, 2008

(30) Foreign Application Priority Data

Jan. 10, 2006 (FR) ..... 06 00189

(51) Int. Cl.
*H01H 9/04* (2006.01)
*H01H 3/04* (2006.01)

(52) U.S. Cl. ..... 200/302.3; 200/17 R; 200/6 A; 200/302.1; 200/332; 200/335

(58) Field of Classification Search ..... 200/6 A, 200/5 R, 17 R, 18, 332, 335, 61.85, 61.88, 200/61.54, 61.27, 302.1–302.3; 341/20, 341/22, 32; 345/156, 157, 160, 161, 168, 345/169, 184; 335/205–207
See application file for complete search history.

(56) References Cited

U.S. PATENT DOCUMENTS 4,187,483 A * 2/1980 Whitney ..... 335/206
4,500,867 A 2/1985 Ishitobi et al.
4,519,266 A * 5/1985 Reinecke ..... 74/471 XY
5,754,167 A 5/1998 Narusawa et al.

(Continued)

FOREIGN PATENT DOCUMENTS

DE 34 31 523 A1 3/1986

(Continued)

*Primary Examiner*—Michael A Friedhofer
(74) *Attorney, Agent, or Firm*—Oliff & Berridge, PLC

(57) ABSTRACT

Remote control for a mobile machine, in particular a heavy construction machine, agricultural or handling machine comprising a remote control body, a lever fixedly attached to a handle designed to be held by a user, means for connecting the lever to the body allowing a movement of the lever relative to the body on at least one axis, and means for detecting the relative movement of the lever relative to the body of the remote control, the signals originating from the detection means being designed for the control of a member of the mobile machine. The detection means are of the contactless type, and the remote control body comprises a sealed wall separating on the one hand the detection means that are situated on a first side of the sealed wall, and on the other hand, the lever and the means for connecting the lever to the body that are situated on a second side of the sealed wall.

13 Claims, 1 Drawing Sheet

U.S. PATENT DOCUMENTS

| | | | | |
|---|---|---|---|---|
| 5,831,554 | A * | 11/1998 | Hedayat et al. | 341/20 |
| 5,934,324 | A | 8/1999 | Bessard | |
| 6,175,290 | B1 * | 1/2001 | Forsythe et al. | 335/207 |
| 6,266,046 | B1 * | 7/2001 | Arita | 345/156 |
| 6,606,085 | B1 * | 8/2003 | Endo et al. | 345/161 |
| 6,825,831 | B1 * | 11/2004 | Passaro | 345/167 |
| 7,019,238 | B2 * | 3/2006 | Kobayashi | 200/310 |
| 7,151,526 | B2 * | 12/2006 | Endo | 345/156 |
| 7,352,174 | B1 * | 4/2008 | Lee | 324/207.25 |
| 7,595,712 | B2 * | 9/2009 | Nishino et al. | 335/207 |
| 2002/0003527 | A1 | 1/2002 | Baker et al. | |
| 2004/0183778 | A1 * | 9/2004 | Endo | 345/156 |

FOREIGN PATENT DOCUMENTS

| | | | |
|---|---|---|---|
| DE | 35 06 293 | A1 | 9/1986 |
| DE | 198 27 481 | A1 | 12/1998 |
| GB | 2 287 526 | A | 9/1995 |

* cited by examiner

REMOTE CONTROL FOR A MOBILE MACHINE, IN PARTICULAR A HEAVY CONSTRUCTION MACHINE, AGRICULTURAL OR HANDLING MACHINE

The present invention relates to a remote control for a moving machine, particularly a heavy construction machine, an agricultural machine or a handling machine.

BACKGROUND OF THE INVENTION AND DESCRIPTION OF THE PRIOR ART

It is known practice, particularly from document DE 34 31 523, to use a remote control for a moving machine comprising:

- a remote control body
- a lever secured to a handle intended to be held by a user in his hand,
- connecting means for connecting the lever to the body allowing the lever to move with respect to the body about at least one axis,
- detection means, of the contactless type for detecting the relative movement of the lever with respect to the body of the remote control, the signals from the detection means being intended to control a component of the moving machine.

A remote control such as this needs to be sealed to ensure correct operation throughout the life of the equipment. Sealing the handle is particularly important for cabs of moving machines intended to be washed down with water or, in the case of open cabs, intended to be left open to the elements.

It is known practice to provide sealing between the various moving parts of the remote control by fitting a flexible and sealed gaiter fixed, on the one hand, to the body and, on the other hand, to the handle and to the lever secured to this handle.

A solution such as this does indeed allow the remote control to be sealed.

It is also known practice to coat the electrical components of remote controls to prevent any liquid that enters the remote control body from damaging the components or causing short circuits.

It has however become apparent that fitting a gaiter makes the remote control more complicated to produce. Furthermore, the gaiter may be partially removed from its protective position, or become worn, and under such conditions allow liquids to enter.

Resin coating for its part also entails additional stages in the production of the remote control, before the electrical components are fitted to this remote control.

The technical problem that therefore arises is that of providing a remote control of the aforementioned type which guarantees that the remote control is sealed, under normal conditions of use, without exhibiting any additional wearing component and without making the remote control more complicated to produce.

SUMMARY OF THE INVENTION

To this end, the solution according to the invention relates to a remote control for a moving machine of the type described hereinabove, characterized in that the remote control body comprises a sealed wall, separating, on the one hand, the detection means which are situated on a first side of the sealed wall from, on the other hand, the lever and the means of connecting the lever to the body, which are situated on the second side of the sealed wall.

These arrangements guarantee that the remote control body will remain sealed without requiring any wearing components of the gaiter type. They allow the mechanical part of the remote control containing the moving parts to be separated from the electronic detection part, the two parts being situated one on each side of a sealed wall.

This sealing can be afforded when the remote control body itself comprises a closed casing, or when the body is fixed to a support wall with an opening passing through the wall, the sealed wall of the body ensuring the continuity of the seal with the support wall.

According to one embodiment, the sealed wall comprises an impression in which the base of the lever can be housed. The impression projects from the first side of the sealed wall.

Advantageously, the detection means are positioned on the walls of the impression, on the first side of the sealed wall.

The impression and positioning the detection means on the wall of the lever mean that effective detection of the movement of the lever about one or more axes can be obtained while at the same time guaranteeing sealing. This is because the distance between the detection means and the base of the lever is small, these elements simply being separated by the walls of the impression that forms part of the sealed wall.

Advantageously, the detection means comprise at least one Hall-effect sensor, and the lever comprises a permanent magnet.

According to one embodiment, the permanent magnet is positioned at the base of the lever situated in proximity to the body.

Advantageously, the sealed wall at least partially delimits a compartment formed in the body in which the detection means are housed. A compartment such as this protects the components, it being possible for this compartment to be closed or left open.

Advantageously, the compartment delimited by a sealed wall is at least partially filled with resin.

According to one embodiment, the remote control comprises guide means for guiding cables or wires forming a guide path circumnavigating the sealed wall.

This arrangement allows cables or wires to be routed without detracting from the desired sealing of the detection means.

According to one embodiment, the connecting means are housed in the impression formed in the sealed wall.

Advantageously, the remote control additionally comprises return means for returning the lever to a neutral position.

According to one embodiment, the remote control comprises protection means intended to avoid a cable or a wire becoming nipped between the lever or the connecting means and the body or with the return means for returning the lever to a neutral position.

According to one embodiment, the connecting means form a ball joint.

The present invention also relates to a method of manufacturing a remote control for a moving machine, particularly a heavy construction machine, an agricultural machine or a handling machine as described hereinabove, characterized in that it involves a step that consists in injecting resin in the liquid or pasty state into a space at least partially delimited by a sealed wall.

This arrangement is made possible by the fact that the body comprises a sealed wall. It is thus possible to inject resin directly into the remote control, thus avoiding having to carry out a preliminary step of coating the components with resin in a first container, then detaching the components from the mold once the resin has cured, and finally positioning them in the remote control.

All that is in fact required is for the resin to be injected directly onto the sealed wall, possibly completing the demarcation of the space into which resin is to be injected using the sealed wall together with temporary walls that are removed after injection if the wall does not form a compartment of concave shape.

In any event, the invention will be clearly understood from the description which follows, with reference to the attached schematic drawing which by way of nonlimiting example depicts an embodiment of a remote control apparatus according to the invention.

DESCRIPTION OF THE PREFERRED EMBODIMENTS

Figure 4:
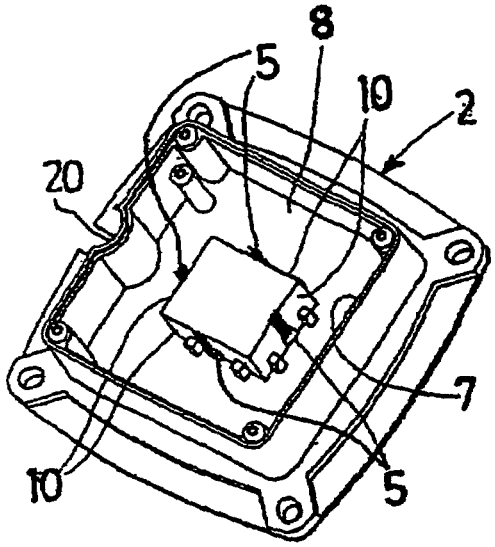
FIG. 4 is a perspective view of the body from beneath.
Figure 3:
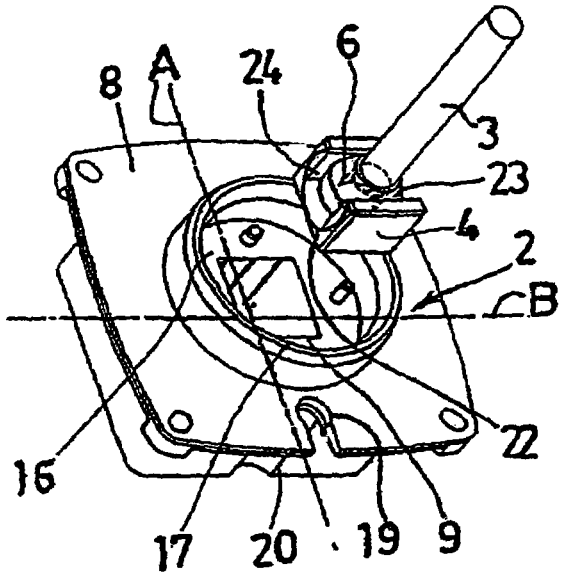
FIG. 3 is an exploded perspective view of the body, the connecting means and the lever.
Figure 2:
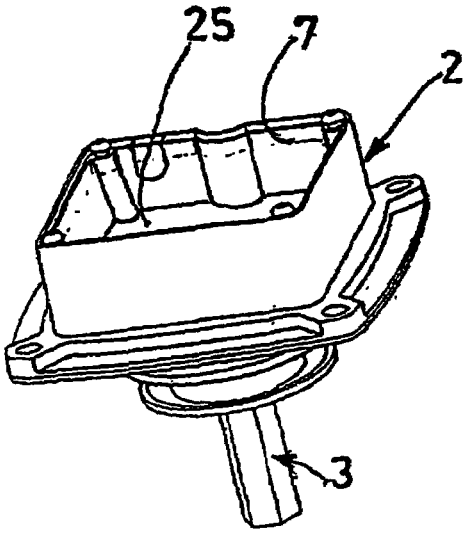
FIG. 2 is a perspective view of the remote control of FIG. 1, viewed from beneath.
Figure 1:
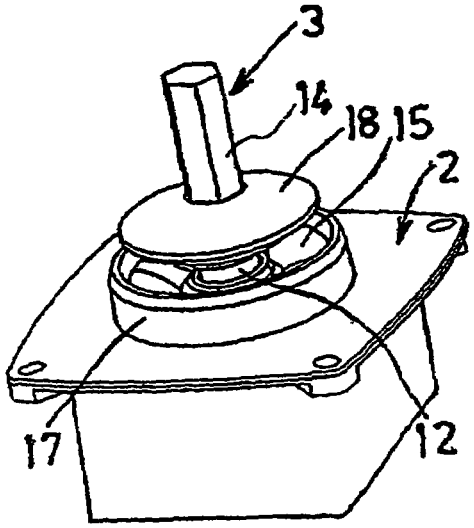
FIG. 1 is a perspective view of a remote control according to the invention, viewed from above.

As depicted in FIGS. 1 to 4, a remote control for a moving machine according to the invention comprises:

- a remote control body 2,
- a lever 3 secured to a handle, not depicted, intended to be held by a user in his hand,
- connecting means 4 for connecting the lever to the body allowing the lever 3 to move with respect to the body 2,
- detection means 5 for detecting the relative movement of the lever 3 with respect to the body 2 of the remote control, the signals from the detection means being intended for controlling a component of the moving machine, external to the remote control.

The remote control body 2 comprises at least one compartment 7 delimited by a sealed wall 8 and in which the detection means 5, which are of the contactless type, are housed.

The sealed wall constitutes the top wall of the body 2. The sealed wall also constitutes the side walls of the body.

The compartment 7 is intended to be closed by a cover, not depicted, that can be screwed onto the wall 8, and supplements the sealing.

The detection means comprise Hall-effect sensors 5 which collaborate with a permanent magnet 6 housed in the base of the lever 3 situated in proximity to the body.

The wall 8 of the body 2 accommodating the lever 3 comprises an impression 9 capable of accommodating the means 4 of connection between the body 2 and the lever 3, and the base of the lever 3 comprising the magnet 6.

The detection means 5 are positioned on the interior walls of the impression, on the same side as the interior wall of the body 2, that is to say on the same side as the compartment 7.

In the embodiment depicted, the lever is intended to be able to move about two axes of rotation A and B directed substantially at right angles to one another. The axes of rotation A and B are directed substantially at right angles to the walls of the impression, the impression 9 having a rectangular cross section when viewed in a plane perpendicular to the axis of the lever.

Positioned on each of the four faces 10 of the impression which are perpendicular to the top face of the body 3 is a Hall-effect sensor 5. Thus, two sensors are used per axis of rotation of the lever, thus ensuring redundancy in the control signals emitted.

Advantageously, the magnet 6 situated in the base of the lever 3 can be oriented in such a way that the axis between its north pole and its south pole lies along the axis of the lever 3.

The remote control additionally comprises return means for returning the lever to a neutral position.

The return means for returning the lever to the neutral position comprise a centerpiece 12 capable of translation movement along the lever, subjected to the action of elastic means consisting of a compression spring, not depicted, bearing, on the one hand, on the centerpiece and, on the other hand, on a sleeve 14 introduced over the lever and secured thereto.

The neutral-return means comprise an element 15 of concave shape substantially in the shape of an inverted cone, positioned in a housing 16 in the outer face of the body around the impression 9 delimited by a peripheral wall 17.

The centerpiece 12, under the action of the spring, collaborates with the surface of the concave-shaped element 15 to return the lever 3 to a neutral position substantially perpendicular to the plane of the upper wall of the body 2.

The sleeve additionally comprises a skirt 18 situated above and at least partially covering the concave element 15, the centerpiece 12 and the spring.

This skirt 18 constitutes a protection means intended to prevent cables or conducting wires from being nipped between the lever or the connecting means and the body or with means for returning the lever to a neutral position.

Specifically, a remote control commonly comprises cables or electric wires connecting control elements, particularly buttons, situated on the handle, to components external to the remote control.

The remote control also comprises guide means for guiding the cables or wires and which consists of guide recesses 19, 20 formed on the exterior wall of the compartment 7.

Thus, the routing of the cables or wires does not detract from the desired sealing of the compartment comprising the detection means 5.

The connecting means 4 connecting the lever 3 and the body consist of a hollow member the external shape of which substantially complements the shape of the impression 9, to ensure that the member will be held in position with respect to the body, the member comprising a housing 22 with an opening delimited by a retaining edge 23, the housing accepting the base of the lever, which comprises an end portion 24 of dimensions greater than the opening of the housing forming a connection of the ball joint type with the housing.

Advantageously, the connection allows rotation about the two axes A and B but not rotation about an axis coincident with the axis of the lever. This arrangement can be obtained by using an end portion that has a cross section at right angles to the axis of the lever but is asymmetric, particularly oval, corresponding to a similarly asymmetric cross section of the housing.

The method of manufacturing a remote control as described hereinabove involves a step that consists in injecting resin 25 in the liquid or pasty state into the compartment 7. The compartment 7 is thus at least partially filled with resin.

According to an alternative form of the invention that has not been depicted, a remote control, intended for example to be fixed to a control panel for a crane, comprises a body fixed to a support wall forming part of the control panel, with an opening through which the body passes. This being the case, the body has no closed housing. The sealed wall of the body does, however, ensure the continuity of the sealing with the support wall that closes the control desk.

As goes without saying, the invention is not restricted to the preferred embodiment described hereinabove by way of non-limiting examples; on the contrary, it encompasses all alternative forms thereof.

The invention claimed is:

1. A remote control for a moving machine, comprising:

a remote control body;

a lever secured to a handle intended to be held by a hand of a user;

at least one connector for connecting the lever to the remote control body allowing the lever to move with respect to the remote control body about at least one axis; and at least one contactless detector for detecting a relative movement of the lever with respect to the remote control body, signals from the contactless detectors being intended to control a component of the moving machine, wherein the remote control body comprises a sealed wall, comprising a top wall and side walls of the remote control body, the sealed wall separating the at least one contactless detector, which is situated on a first side of the sealed wall from the lever and the at least one connector, which are both situated on a second side of the sealed wall.

2. The remote control as claimed in claim 1, wherein the sealed wall further comprises an impression in which a base of the lever can be housed.

3. The remote control as claimed in claim 2, wherein the at least one contactless detector is positioned on a wall of the impression, on the first side of the sealed wall.

4. The remote control as claimed in claim 2, wherein the at least one connector is housed in the impression formed in the sealed wall.

5. The remote control as claimed in claim 1, wherein the at least one contactless detector comprises at least one Hall-effect sensor, and the lever comprises a permanent magnet.

6. The remote control as claimed in claim 5, wherein the permanent magnet is positioned at a base of the lever situated in proximity to the remote control body.

7. The remote control as claimed in claim 1, further comprising a guide for guiding cables or wires forming a guide path circumnavigating the sealed wall.

8. The remote control as claimed in claim 1, wherein the sealed wall at least partially delimits a compartment formed in the remote control body that houses the at least one contactless detector.

9. The remote control as claimed in claim 8, wherein the compartment delimited by the sealed wall is at least partially filled with resin.

10. The remote control as claimed in claim 1, further comprising a return for returning the lever to a neutral position.

11. The remote control as claimed in claim 10, further comprising a protector for protecting a cable or a wire from becoming nipped between the lever or the connecting means and the body or from being nipped by the return for returning the lever to a neutral position.

12. The remote control as claimed in claim 1, wherein the at least one connector forms a ball joint.

13. A method of manufacturing a remote control for a moving machine, as claimed in claim 1, comprising injecting resin in a liquid or pasty state into a space at least partially delimited by the sealed wall.

* * * * *